US005207464A

United States Patent [19]

Reeves, Jr.

[11] Patent Number: 5,207,464

[45] Date of Patent: May 4, 1993

[54] TWO PIECE DOOR STOP DEVICE FOR PREVENTING UNAUTHORIZED ENTRY

[76] Inventor: Lewis W. Reeves, Jr., 7421 Belle River Ct., Winter Park, Fla. 32792

[21] Appl. No.: 919,745

[22] Filed: Jul. 22, 1992

[51] Int. Cl.[5] ..... E05C 17/54

[52] U.S. Cl. ..... 292/339; 292/343; 292/DIG. 15

[58] Field of Search ..... 292/339, 338, 342, 343, 292/DIG. 15; 254/39

[56] References Cited

U.S. PATENT DOCUMENTS

| | | | |
|---|---|---|---|
| 776,378 | 11/1904 | Bellamy | 292/343 |
| 1,392,467 | 10/1921 | Topp | 292/339 |
| 2,626,826 | 1/1953 | Dritz | 292/343 |
| 2,898,140 | 8/1959 | Gislason | 292/342 |
| 4,805,948 | 2/1989 | Renzi | 292/342 |

FOREIGN PATENT DOCUMENTS

| | | | |
|---|---|---|---|
| 194965 | 3/1923 | United Kingdom | 292/343 |
| 714184 | 8/1954 | United Kingdom | 292/342 |

*Primary Examiner*—Rodney M. Lindsey
*Attorney, Agent, or Firm*—Julian C. Renfro

[57] ABSTRACT

A door stop for temporary installation at the base of a door, for preventing an intruder from pushing the door open. This novel door stop comprises a generally wedge-shaped device having first and second ends, with the first end of the wedge-shaped device having a narrow thickness dimension suitable for insertion under the door at a location remote from the door hinge. The second end of the wedge-shaped device has a substantially larger thickness dimension. A height adjustment device is operatively disposed on the second end of the wedge-shaped device, with this adjustment device enabling the effective height of the wedge-shaped device to be selectively increased by the user. In this way a substantial upward force can be applied under the door, thus to effectively anchor the wedge-shaped device to the underside of the door. An elongate, rigid member is operatively associated with the wedge-shaped device, with the elongate, rigid member having angled ends enabling it to extend in an angular, door-blocking relationship between the floor and a lower portion of the door. To prevent displacement of the elongate, rigid member from a door-blocking relationship, I utilize a component for attaching a mid portion of the elongate, rigid member to the wedge-shaped device. This component may for example be a tension spring.

6 Claims, 1 Drawing Sheet

TWO PIECE DOOR STOP DEVICE FOR PREVENTING UNAUTHORIZED ENTRY

BACKGROUND OF THE INVENTION

Many doors, both interior doors as well as exterior doors, are not equipped with satisfactory locking means. Accordingly, many travelers staying overnight in certain hotels and motels resort to the use of certain door-blocking devices that will provide more security against unauthorized entry. Such door-blocking devices can include the use of a rigid chair wedged under the door knob, a heavy piece of furniture placed against the door, or a type of cable looped over the door handle and affixed to the door casing.

There is a distinct need for a relatively simple, but highly effective door-blocking device for use in conjunction with doors having an insufficient locking arrangement, but such device should not be of such a nature as to mar or deface the door, the door casing, or the floor adjacent the door. The door-blocker should be of sturdy construction, readily installed, readily removed when the threat has subsided, be of a configuration that can be readily transported in a handbag or briefcase, and be affordable.

It is the purpose of this invention to provide such a device.

SUMMARY OF THE INVENTION

A door stop for temporary installation at the base of a door in accordance with this invention is designed to prevent an intruder from pushing the door open, with this novel door stop comprising a generally wedge-shaped device having first and second ends, and an elongate, rigid member used therewith. The first end of the wedge-shaped device has a narrow thickness dimension suitable for insertion under the door at a location remote from the door hinge, and the second end of the wedge-shaped device has a substantially larger thickness dimension.

The wedge-shaped device includes an adjustment means operatively disposed adjacent the second end of the wedge-shaped device, with such adjustment means enabling the effective height of the wedge-shaped device to be selectively increased by the user. In this way a substantial upward force can be applied under the door, thus to effectively anchor the wedge-shaped device to the underside of the door, in effect utilizing the floor as part of the lock.

The elongate, rigid member operatively associated with the wedge-shaped device has angled ends enabling it to extend in an angularly disposed, door-blocking relationship between the floor and a lower portion of the door, with means serving to anchor a mid portion of the elongate, rigid member to the wedge-shaped device. In this way the displacement of the elongate, rigid member from a door-blocking relationship is effectively prevented. As will be more apparent as the description proceeds, the elongate, rigid member preferably has angled ends, and is intended to reside at approximately a 45° angle to the door and to the floor, for this has been found to be the most effective and strongest angle in which a door-blocking device may be utilized.

I provide an effective anchor arrangement for the elongate, rigid member, to prevent it from unintentional displacement, and this anchor arrangement may take the form of a tension spring, with one end of the spring hooked to a mid portion of the elongate, rigid member, and the other end hooked to the end or portion of the wedge-shaped device not actually extending under the door.

In use, the user inserts the narrow end of the wedge-shaped device under the door at a location remote from the hinge of the door, and then he or she proceeds to tighten the adjustment means of the wedge, so as to cause the wedge to tightly engage the underside of the door in a non-slip relationship. Thereafter, the user may proceed to place the elongate, rigid member in a 45° relationship to the door at a location near the wedge, and then to interconnect the rigid member and the wedge. Because of this highly advantageous arrangement, any dislodgment of the rigid member from the door-blocking relationship is quite unlikely.

After my novel door stop has served its purpose, the rigid member may be unhooked from the spring, and the user can operate the adjustment means in the loosening direction in order to facilitate the removal of the wedge from the location under the door. The wedge, the spring and the elongate, rigid member occupy a small amount of space, so they may be readily transported by merely inserting these members into a purse, handbag or briefcase.

Although the components of my novel door stop could be made of metal, I have found, in the interests of lightness and economy, that many industrial grade plastics can be utilized in the construction of the wedge and the elongate, rigid member. In addition, if the wedge and the rigid member are plastic, it becomes less likely that a guard will raise a question with respect to a potentially unauthorized device in a traveler's luggage as he or she endeavors to pass through a metal detector at an airport or other such location where metal detectors are to be found.

It is therefore a principal object of this invention to provide a highly effective yet low cost device of simple construction that can be readily used by the occupant of a room to assure that the entry door will not be pushed open by an unauthorized person.

It is another object of this invention to provide a door stop that is easy to manufacture, safe and effective in use, of light weight, and easily transportable in a traveler's hand luggage.

It is yet another object of this invention to provide a door stop of attractive appearance, that can be installed adjacent the base of entry door by a person possessing little mechanical knowledge, but that will effectively prevent the door being pushed open by an unauthorized person.

It is still another object of this invention to provide an inexpensive door stop affording great security to the occupant of a room in which the entry door is not provided with an effective lock, thus making it possible for the room occupant to sleep more soundly than would otherwise be possible.

These and other objects, features and advantages will be more apparent from a study of the appended drawings.

DETAILED DESCRIPTION

Figure 1:
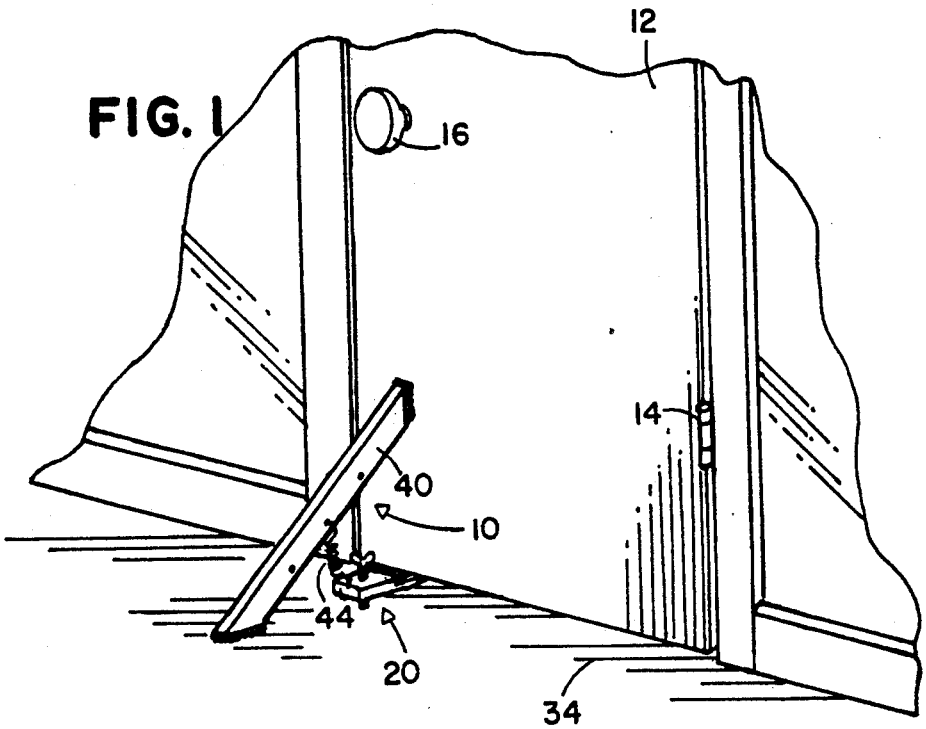
FIG. 1 is a perspective view of my novel door stop involving a novel wedge used in conjunction with an elongate, rigid member, with these being illustrated in their operative relationship with respect to the base of a door, to effectively prevent an unauthorized person from pushing the door open.

With initial reference to FIG. 1, it will there be seen that I have shown a typical installation involving the use of my highly advantageous door stop 10 temporarily employed at the base of a door 12, to prevent the door from being pushed open by an unauthorized person. The door 12 is presumed to be hingedly supported by two or more conventional hinges 14, only one of which is depicted in FIG. 1, for this figure illustrates only the lower portion of a door. The door 12 may be equipped with a conventional latch and a doorknob 16.

Figure 2:
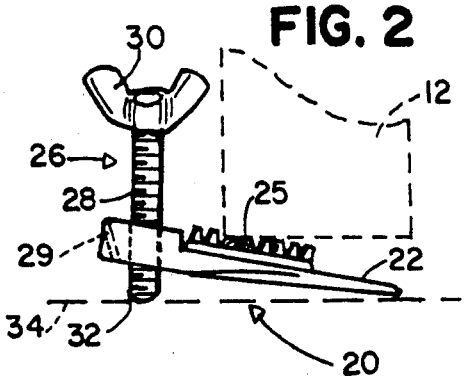
FIG. 2 is a side elevational view of the novel wedge I prefer to utilize as an intrinsic part of my door stop.

My novel door stop 10 comprises a generally wedge-shaped device 20 having first and second ends, utilized in concert with an elongate, rigid member 40. I may also refer to the device 20 as being a first member of thin construction. As best seen in FIG. 2, the first end 22 of the wedge-shaped device has a narrow thickness dimension suitable for insertion under the door at a location remote from the door hinge, whereas the second end 24 of the wedge-shaped device may have a substantially larger thickness dimension.

Figure 3:
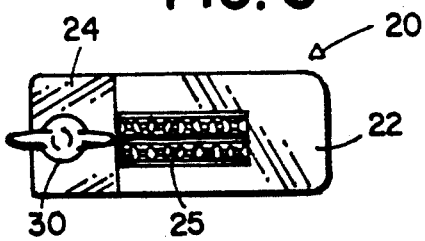
FIG. 3 is a top view of the novel wedge depicted in FIG. 2.

As visible in FIG. 2 as well as FIG. 3, adjustment means 26 is operatively disposed in the second end 24 of the wedge-shaped device, for enabling the effective height of the wedge-shaped device 20 to be selectively increased by the user. I preferably utilize an adjustment means 26 in the form of a threaded, screw-like member, having threads 28 that threadedly engage internal threads located in the second end of the wedge 20. However, I am not to be limited to this precise construction for enabling the effective height of the wedge being increased. Rather than being in a perpendicular relationship to the wedge, the adjustment means 26 may be disposed at an angle to the base or second portion of the wedge 20, as revealed in FIG. 2, but this is not a firm requirement.

Protruding, wing-like members 30 on the end of the elongate adjustment means 26 remote from the wedge form a means readily engaged by the thumb and fingers of the user, so that the adjustment means 26 can be easily rotated by the user in a desired direction. The lower end 32 of the adjustment means 26 is positioned so as to move into contact with the floor 34 when the adjustment means is rotated in the tightening direction.

As a result of this arrangement, when the first end of the wedge 20 has been placed under the door 12 in the manner depicted in FIG. 1, a substantial upward force can be applied under the door 12 when the adjustment means 26 is rotated in the tightening direction. In this way, the wedge 20 is effectively anchored to the underside of the door, or in other words, the first member 20 is enabled to achieve a locked relationship with the bottom edge of the door.

It is a fact that some doors have more bottom clearance than others, thus making it important for the adjustment means 26 to have sufficient length as to be usable with a wide range of doors. For use with doors having substantial bottom clearance, I prefer to use a pad 25 on the upper surface of the wedge, near the adjustment means. The pad 25 may be of carpet-like material, rubber, plastic or the like that has been caused to adhere to the upper surface of the wedge or first member 20. Thus, if the door in conjunction with which my device is utilized has a substantial bottom clearance, the use of the pad 25 makes it possible to firmly secure the wedge in a non-slip relationship at the bottom of the door without having to rotate the adjustment means 26 to a substantial extent.

On the other hand, if the door has a very close fit with respect to the threshold of the door, the pad 25 may be removed. To this end I prefer to utilize a sticky material or peelable adhesive for holding the pad in place on the wedge, while still permitting the pad to be removed and thereafter reinserted upon the wedge for a large number of times.

Figure 4:
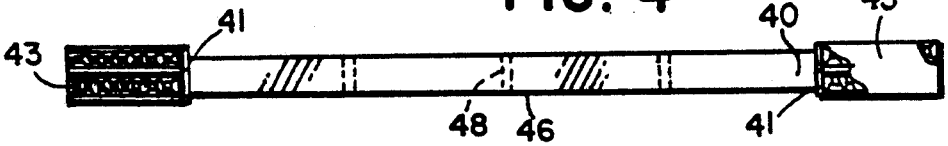
FIG. 4 is an edge view of the elongate, rigid member I preferably utilize in a 45° relationship to the door, to prevent an unauthorized person from pushing the door open.
Figure 5:
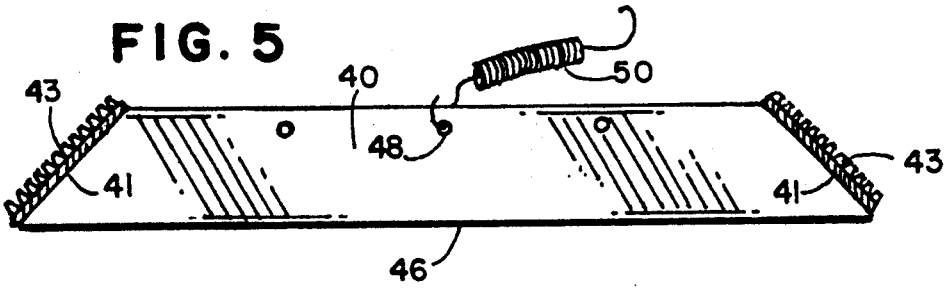
FIG. 5 is a plan view of the rigid member depicted in FIG. 4, with the plan view illustrating how the ends of the elongate, rigid member are preferably angled, and residing at a 45° angle to the longitudinal axis of the rigid member.

As previously mentioned, an elongate, rigid member 40 is operatively associated with the wedge-shaped device 20. As depicted in FIGS. 4 and 5, the elongate, rigid member 40, also known as a second member, preferably has angled ends 41 enabling it to extend in an angularly disposed door-blocking relationship between the floor 34 and a lower portion of the door 12. Through experimentation, I have found that the most effective positioning of the elongate, rigid member is when it forms a 45° angle with respect to both the door 12 and the floor 34. Therefore, I prefer for both of the ends 41 of the second member 40 to be disposed at a 45° angle with respect to the longitudinal centerline of the member 40. Because the ends are identically angled, there is no one orientation of the member 40 that must be utilized, for either angled end may be placed against the door 12.

The first and second door stop members 20 and 40 are not required to be at any certain position with respect to the long edge of the door remote from the hinges, but in most instances, the members are installed approximately two inches from the edge of the door 12 in which the latch is installed.

To guard against undesirable slippage, I may secure carpet material, rubber or serrated plastic members 43 on each angled end 41 of the rigid member 40, to bring about a no-slip construction.

To prevent undesired displacement of the elongate, rigid member from the desired door-blocking relationship, I provide means 44 serving to anchor the mid portion 46 of the elongate, rigid member 40 to the wedge-shaped device 20, so that the members 20 and 40 can function in a closely related manner.

I prefer for the means 44 serving to anchor the mid portion of said elongate, rigid second member 40 to the wedge-shaped first member 20 to be a tension spring 50, although other kinds of securing devices, such as a bungee cord, could be substituted if desired. I provide a hole 48 in the mid portion 46 of the rigid member 40, and a hole 29 in the second end 24 of the wedge 20, for receiving the ends of the spring 50. I provide a curved, hook portion on each end of the spring, to enable the user to readily attach the spring to the rigid member and to the wedge. To facilitate this effort, I provide a straight portion on each end of the spring, before the commencement of the coils, so that the user will be readily able to insert the hooked ends of the spring 50 into the holes 48 and 29 in the rigid member 40 and the wedge 20, respectively. Because of the straight spring portions, the coils of the spring do not interfere at the time the user is going about connecting the spring to the wedge and the rigid member.

I have found that if the first and second members 20 and 40 are made of a strong, industrial grade plastic, my entire door stop device can be carried through a metal detector without an alarm being sounded. This is because the spring 50, even though of steel or other appropriate metal, has a sufficiently small mass as not to be detectable at the time my device is passed through a typical scanner.

I claim:

1. A door stop for temporary installation at the base of a door, for preventing an intruder from pushing the door open, said door stop comprising a generally wedge-shaped device having first and second ends, said first end of said wedge-shaped device having a narrow thickness dimension suitable for insertion under the door at a location remote from the door hinge, and said second end of said wedge-shaped device having a substantially larger thickness dimension, adjustment means operatively disposed adjacent said second end of said wedge-shaped device, said adjustment means enabling the effective height of said wedge-shaped device to be selectively increased by the user, such that a substantial upward force can be applied under the door, thus to effectively anchor said wedge-shaped device to the underside of the door, and an elongate, rigid member operatively associated with said wedge-shaped device, said elongate, rigid member having angled ends enabling it to extend in an angularly disposed, door-blocking relationship between the floor and a lower portion of the door, and means serving to attach a mid portion of said elongate, rigid member to said wedge-shaped device, to prevent displacement of said elongate, rigid member from a door-blocking relationship.

2. The door stop as recited in claim 1 in which said adjustment means is a threaded, screw-like member that is rotatable to change the effective height relationship of said wedge-shaped device with respect to the door.

3. The door stop as recited in claim 1 in which said means serving to attach the mid portion of said elongate, rigid member to said wedge-shaped device is a tension spring.

4. A door stop for temporary installation at the base of a door, for preventing an intruder from pushing the door open, said door stop comprising a generally wedge-shaped device utilized in an operative combination with an elongate, rigid member serving on occasion to block the opening of the door with which it is used, said wedge-shaped device having first and second ends, said first end of said wedge-shaped device having a narrow thickness dimension suitable for insertion under the door at a location remote from the door hinge, and said second end of said wedge-shaped device having a substantially larger thickness dimension, adjustment means operatively disposed adjacent said second end of said wedge-shaped device, said adjustment means enabling the effective height of said wedge-shaped device to be selectively increased by the user, such that a substantial upward force can be applied under the door, thus to establish an effective, binding relationship with a lower portion of the door, said elongate, rigid member having angled ends enabling it to extend in an angular attitude between the floor and a lower portion of the door in a door-blocking relationship, and means serving to anchor a mid portion of said elongate, rigid member to said wedge-shaped device, to prevent unintentional displacement of said elongate, rigid member from the door-blocking relationship.

5. The door stop as recited in claim 4 in which said adjustment means is a threaded, screw-like member that is rotatable to change the effective height relationship of said wedge-shaped device with respect to the door.

6. The door stop as recited in claim 4 in which said means serving to anchor the mid portion of said elongate, rigid member to the wedge-shaped device is a tension spring.

* * * * *